US008750737B2

(12) United States Patent
Lee et al.

(10) Patent No.: US 8,750,737 B2
(45) Date of Patent: Jun. 10, 2014

(54) IMAGE FORMING APPARATUS AND METHOD FOR CONTROLLING FUSER THEREOF

(75) Inventors: Jin-seok Lee, Suwon-si (KR); Bong-hee Lee, Suwon-si (KR); Sang-uk Jeon, Yongin-si (KR); Dong-kyun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 623 days.

(21) Appl. No.: 12/929,351

(22) Filed: Jan. 18, 2011

(65) Prior Publication Data

US 2012/0063798 A1 Mar. 15, 2012

(30) Foreign Application Priority Data

Sep. 10, 2010 (KR) ..... 10-2010-0088895

(51) Int. Cl.
*G03G 15/20* (2006.01)

(52) U.S. Cl.
USPC ..... 399/67; 399/328

(58) Field of Classification Search
USPC ..... 399/67, 324, 328
See application file for complete search history.

(56) References Cited

U.S. PATENT DOCUMENTS

2004/0091279 A1* 5/2004 Izawa et al. ..... 399/67

* cited by examiner

*Primary Examiner* — David Gray
*Assistant Examiner* — Andrew Do
(74) *Attorney, Agent, or Firm* — Staas & Halsey LLP

(57) ABSTRACT

An image forming apparatus includes a heat roller heated to a preset temperature; a pressure roller for having conductivity and forming a nip by pressure-contacting with the heat roller; a power supply unit to apply a bias voltage to the pressure roller; and a controller to, when a printing paper enters the nip, control the power supply unit to apply the bias voltage to the pressure roller. When a time interval is longer than a preset time, the controller can control the power supply unit not to apply the bias voltage when the printing paper is not placed in the nip, and when the time interval is shorter than the preset time, the controller can control the power supply unit to apply the bias voltage when the printing paper is not placed in the nip.

13 Claims, 5 Drawing Sheets

IMAGE FORMING APPARATUS AND METHOD FOR CONTROLLING FUSER THEREOF

CROSS-REFERENCE TO RELATED APPLICATIONS

This application claims the priority benefit under 35 U.S.C. §119 (a) from Korean Patent Application No. 10-2010-0088895 filed on Sep. 10, 2010 in the Korean Intellectual Property Office, the entire disclosure of which is incorporated herein by reference.

BACKGROUND

1. Field

Embodiments relate generally to an image forming apparatus and a fuser controlling method thereof. More particularly, the present disclosure relates to an image forming apparatus for minimizing offset by controlling a fuser in a different controlling method according to a time interval of a printing paper entering the fuser, and a fuser controlling method thereof.

2. Description of the Related Art

An image forming apparatus is a device which prints printing data generated at a printing control terminal such as computer, onto a printing paper. Examples of the image forming apparatus include a copier, a printer, a fax machine, and a Multi Function Peripheral (MFP) integrating functions of the copier, the printer, and the fax machine in a single apparatus.

The image forming apparatus can form the image in various manners. One of the various methods is an electrophotographic method. The electrophotographic method forms the image by charging a photoconductor surface, forming a latent image through exposure, developing the latent image with toner, transferring the developed toner onto a printing paper, and fusing the image.

As such, the image forming apparatus can employ the unit for ultimately fusing the image onto the printing paper, which is referred to as a fuser.

In general, the fuser fixes the image on the printing paper by applying heat and pressure. In recent, by applying the (+) voltage to a pressure roller, the force of attaching the charged toner of the (−) polarity to the printing paper is increased.

Meanwhile, when the printing papers are input in succession, a conventional image forming apparatus continuously applies a bias voltage in the printing section. When the bias voltage is applied continuously, the bias voltage applied time extends and the (+) voltage overapplied is accumulated at a heat roller. When the (+) voltage overapplied is accumulated at the heat roller, the (−) charged toner is attracted to the heat roller and the toner on the heat roller can stain the next printing paper, which causes an offset.

To address the offset, a conventional method does not apply the bias voltage to the pressure roller when the printing paper does not pass through the fuser.

When the bias voltage is shut down when the printing paper does not pass through the fuser, it is difficult to apply the voltage to the heat roller or the pressure roller at the same time as the paper passes through in case where the interval of the printing papers is shortened to implement a rapid machine, the paper feeding is unstable.

SUMMARY

An embodiment or embodiments have been provided to address the above-mentioned and other problems and disadvantages occurring in the conventional arrangement, and an aspect provides an image forming apparatus for minimizing offset by controlling a fuser in a different controlling method according to a time interval of a printing paper entering the fuser, and a fuser controlling method thereof.

According to an aspect, an image forming apparatus includes a heat roller heated to a preset temperature; a pressure roller for having conductivity and forming a nip by pressure-contacting with the heat roller; a power supply unit for applying a bias voltage to the pressure roller; and a controller for, when a printing paper enters the nip, controlling the power supply unit to apply the bias voltage to the pressure roller. When a time interval is longer than a preset time, the controller controls the power supply unit not to apply the bias voltage when the printing paper is not placed in the nip, and when the time interval is shorter than the preset time, the controller controls the power supply unit to apply the bias voltage when the printing paper is not placed in the nip.

The preset time may be about 170 ms.

In a duplex printing, the controller may determine that the time interval is longer than the preset time, and in a simplex printing, the controller may determine that the time interval is shorter than the preset time, and selectively controls to or not to apply the bias voltage.

The image forming apparatus may further include a paper detector for detecting whether the printing paper enters the nip. According to a detection result of the paper detector, the controller may measure the time interval between the printing paper and a next printing paper.

The power supply unit may include a conductive member for contacting a surface of the pressure roller; and a switching unit for providing the bias voltage to the conductive member according to control of the controller.

The image forming apparatus may further include a ground unit disposed in vicinity of the nip into which the printing paper is fed, for removing charge on the surface of the heat roller.

A charged toner may be attached to an upper side of the printing paper contacting the heat roller, and the power supply unit may supply the bias voltage of a different polarity from the charged toner.

The charged toner may have (−) polarity, and the bias power may have (+) polarity.

According to the aspect, a method for controlling a fuser of an image forming apparatus includes detecting entrance of a printing paper to a nip between a pressure roller and a heat roller; when the printing paper enters the nip, applying a bias voltage to the pressure roller; calculating a time interval between the printing paper entering the nip and a next printing paper; and selectively controlling to apply the bias voltage while the printing paper is not placed in the nip when the time interval is longer than a preset time, and to apply the bias voltage while the printing paper is not placed in the nip when the time interval is shorter than the preset time.

The selectively controlling operation may selectively control to or not to apply the bias voltage by determining that the time interval is longer than the preset time in a duplex printing, and by determining that the time interval is shorter than the preset time in a simplex printing.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the embodiment will become apparent and more readily appreciated from the following description of the embodiments, taken in conjunction with the accompanying drawings of which.

DETAILED DESCRIPTION

Figure 1:
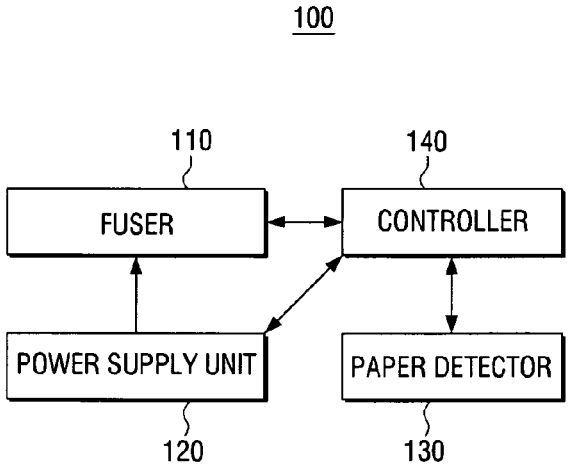
FIG. 1 is a block diagram of an image forming apparatus according to an exemplary embodiment of the invention.

Reference will now be made in detail to the embodiments, examples of which are illustrated in the accompanying drawings, wherein like reference numerals refer to the like elements throughout. The embodiments are described below to explain the embodiment by referring to the figures.

FIG. 1 is a block diagram of an image forming apparatus according to an exemplary embodiment of the invention.

Referring to FIG. 1, the image forming apparatus 100 may include a fuser 110, a power supply unit 120, a paper detector 130, and a controller 140.

The fuser 110 fixes a charged toner onto a printing paper by applying heat and pressure over the printing paper. Structure and operations of the fuser 110 will be explained in detail by referring to FIG. 2.

The power supply unit 120 provides the fuser 110 with a bias voltage for fusing the charged toner on the printing paper. The power supply unit 120 may include a conductive member 121 and a switching unit 123.

The conductive member 121 interconnects a pressure roller 112 and the switching unit 123. In detail, the pressure roller 112 is implemented as a circular roller type. The conductive member 121 can be formed as a brush to keep contacting a surface of the rotating pressure roller 112. The conductive member 121 can be disposed to contact the surface of the pressure roller 112 at the rear end of the fuser 110 based on the rotation direction of the pressure roller 112.

The switching unit 123 supplies the bias voltage to the conductive member 121. Under the control of the controller 140 to be explained, the switching unit 123 can selectively provide the bias voltage to the conductive member 121. In so doing, when the charged toner is of the "−" polarity, the switching unit 123 can apply "+" voltage to the conductive member 121. Conversely, when the charged toner is of the "+" polarity, the switching unit 123 can apply "−" voltage to the conductive member 121.

The paper detector 130 senses whether the printing paper enters. In detail, the paper detector 130 detects whether the printing paper enters the fuser 110. Mostly, the paper detector 130 can be implemented using a feed sensor (not shown) in the image forming apparatus 100. According to the sensing result of the paper detector 130, the controller 140 can acquire a time interval of the printing papers entering the fuser 110.

The controller 140 controls the components of the image forming apparatus 100. When a printing job begins, the controller 140 controls a series of processes to develop the charged toner on the printing paper. When the charged toner is developed on the printing paper, the controller 140 controls the fuser 110 to fix the charged toner onto the printing paper.

More specifically, to fuse the developed printing paper through the fuser 110, the controller 140 controls a temperature of a heat roller 111 to a preset temperature. and the controller 140 can control the power supply unit 120 to apply the bias voltage to the pressure roller 112 based on the paper detection signal of the paper detector 130.

The controller 140 can compare the time interval of the printing papers sensed by the paper detector 130 with a preset time interval, and control the fuser 110 in a different control method according to the comparison result.

In detail, when the time interval of the printing papers fed to the fuser 110 is longer than the preset time (for example, 170 ms), the controller 140 can control the power supply unit 120 not to apply the bias voltage when the printing paper does not pass through the nip 113. Conversely, when the time interval is shorter than the preset time, the controller 140 can control the power supply unit 120 to apply the bias voltage when the printing paper does not pass through the nip 113.

According to whether the current printing job is simplex printing or duplex printing, the controller 140 can control the fuser 110 in the different control method. In more detail, in the duplex printing, the controller 140 can control the power supply unit 120 not to apply the bias voltage when the printing paper does not pass through the nip 113. That is, in the duplex printing, the controller 140 determines that the time interval of the printing papers is longer than the preset time, and can control the power supply unit 120 not to apply the bias voltage when the printing paper does not pass through the nip 113.

Conversely, in the simplex printing, the controller 140 can control the power supply unit 120 to apply the bias voltage when the printing paper does not pass through the nip 113. That is, in the simplex printing, determining that the time interval of the printing papers is shorter than the preset time, the controller 140 can control the power supply unit 120 to apply the bias voltage when the printing paper does not pass through the nip 113.

As such, the image forming apparatus selectively controls to or not to apply the bias voltage when the printing paper does not pass through the nip 113 in the different control method according to the time interval of the printing papers entering the fuser 110. Thus, even an image forming apparatus operating at a high speed can minimize the offset.

Figure 2:
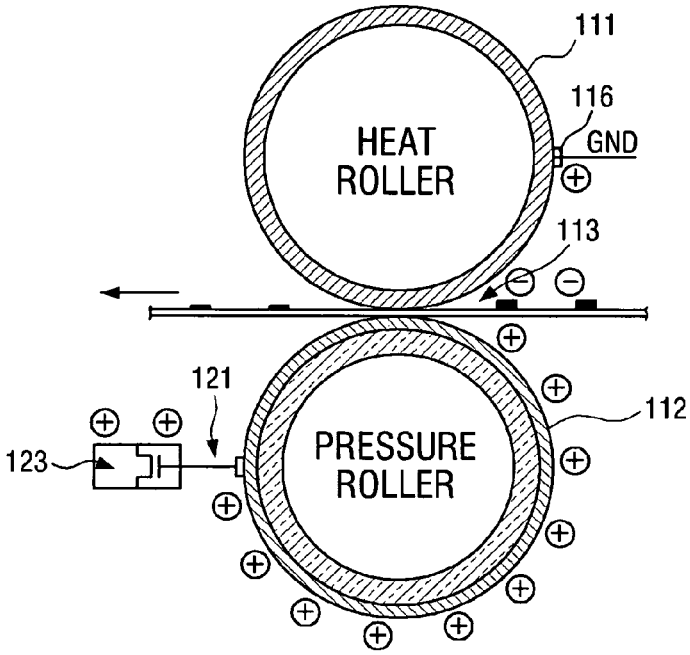
FIG. 2 is a diagram of a fuser of FIG. 1.

FIG. 2 illustrates in detailing an operation of the fuser 110 of FIG. 1.

The fuser 110 of FIG. 2 may include the heat roller 111, the pressure roller 112, and a ground unit 116.

The heat roller 111 is heated to a preset temperature to provide the heat to the printing paper to easily fuse the charged toner on the printing paper. In detail, the heat roller 111 is grounded through the ground unit 116 not to have the polarity over the surface of the heat roller 111. The outer surface of the heat roller 111 is not conductive.

The pressure roller 112 applies the high pressure to the printing paper to easily fuse the charged toner onto the printing paper. In more detail, the heat roller 111 is contacted with the surface of the pressure roller 112 to keep the regular nip 113, the pressure roller 112 is connected to the power supply unit 120 to have the bias voltage over the surface of the pressure roller 112, and the outer surface of the pressure roller 112 is not conductive.

The ground unit 116 makes the heat roller 111 grounded. Since the heat roller 111 is implemented as the circular roller type, the ground unit 116 can be formed as a brush to keep contacting the surface of the rotating heat roller 111. The ground unit 116 can be disposed to contact the surface of the heat roller 111 at the front end of the fuser 110 based on the rotation direction of the heat roller 111.

Figure 3:
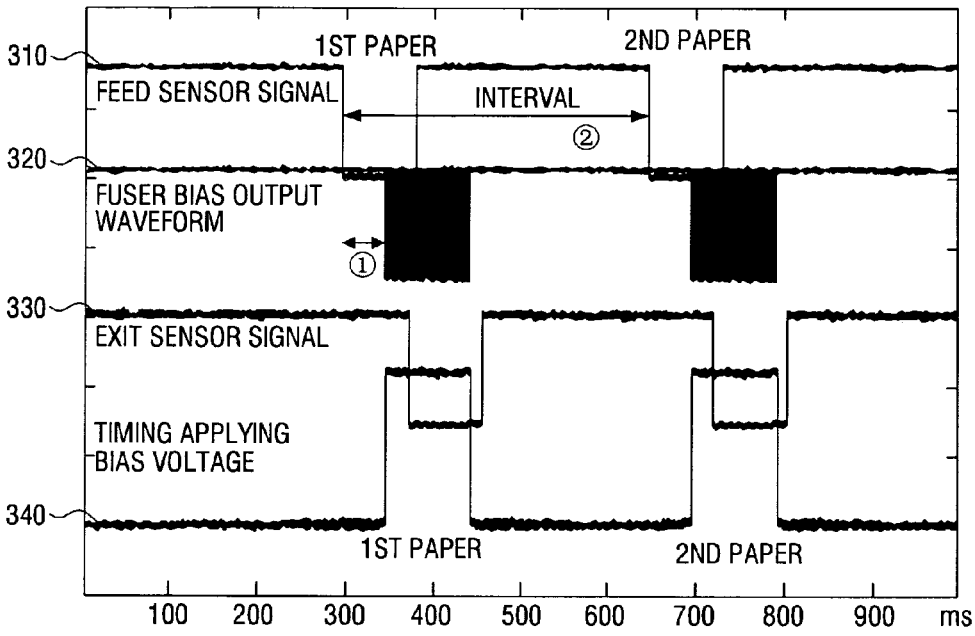
FIGS. 3 and 4 are waveform diagrams of change of a bias voltage according to an exemplary embodiment of the invention.

FIG. 3 is a waveform diagram of the change of the bias voltage when the interval of the printing papers entering the fuser 110 is longer than the preset time.

FIG. 3 illustrates the waveform of a paper detection signal 310, a bias power 320, a paper detection signal 330 at the rear end of the fuser 110, and a timing 340 applying the bias voltage generated at the controller 140.

Hereafter, the operations of the components of the image forming apparatus 100 are explained according to the process of the printing paper by referring to FIG. 3.

First, when the front end of the printing paper enters, the paper detector 130 senses that the paper enters and outputs the paper detection signal 310 as shown in FIG. 3.

When the paper detection signal 310 is output to the controller 140, the controller 140 can calculate that the printing paper enters the fuser 110 after 540 ms ①, using the distance (for example, 205.2 mm) between the paper detector 130 and the fusing nip 113 and the printing paper delivery speed (for example 380 mm/s).

Using the calculated time, the controller 140 can generate the timing 340 applying the bias voltage to the pressure roller 112. For example, the controller 140 can generate the timing 340 applying the bias voltage such that the bias power is turned on after 540 ms after the ON-signal of the paper detector 130 is input.

In FIG. 3, the paper detection signal 310 of the paper detector 130 is turned on, the timing 340 applying the bias voltage is turned on after a predetermined time is delayed, and thus the bias voltage 320 is applied.

Next, when the bias voltage is applied to the first printing paper, the controller 140 can determine whether to apply the bias power when the printing paper is not placed in the nip 113. In detail, the controller 140 can obtain the distance (212 mm) and the time interval ② (212 mm, 560 ms) between the printing papers using the time (560 ms) between the first ON-signal and the second ON-signal of the paper detector 130 and the printing paper delivery speed (380 mm/s).

When the time for which the printing paper is not placed in the nip 113 is longer than the preset time (for example 170 ms) as shown in FIG. 3, the controller 140 can control the power supply unit 120 not to apply the bias power when the printing paper is not placed in the nip 113.

In detail, the controller 140 can provide the power supply unit 120 with the control signal 340 which turns off the bias power when the printing paper is not placed in the nip 113 as shown in FIG. 3. According to the control signal 340, the power supply unit 120 can apply the bias power 320 corresponding to the control signal 340 to the pressure roller 112.

As such, the accurate timing applying the bias voltage is calculated using the measured paper detection signal 310, and the bias voltage is not applied when the printing paper does not pass through the nip 113 according to the calculated timing applying the bias voltage. Thus, the "+" voltage is not overapplied to the pressure roller 112. Since the "+" voltage is not overapplied to the pressure roller 112, the "+" voltage is not accumulated to the heat roller 111 and the negatively charged toner on the printing paper is not attached to the heat roller 111, thus preventing the image abnormality (offset, line burst, and etc.).

Figure 4:
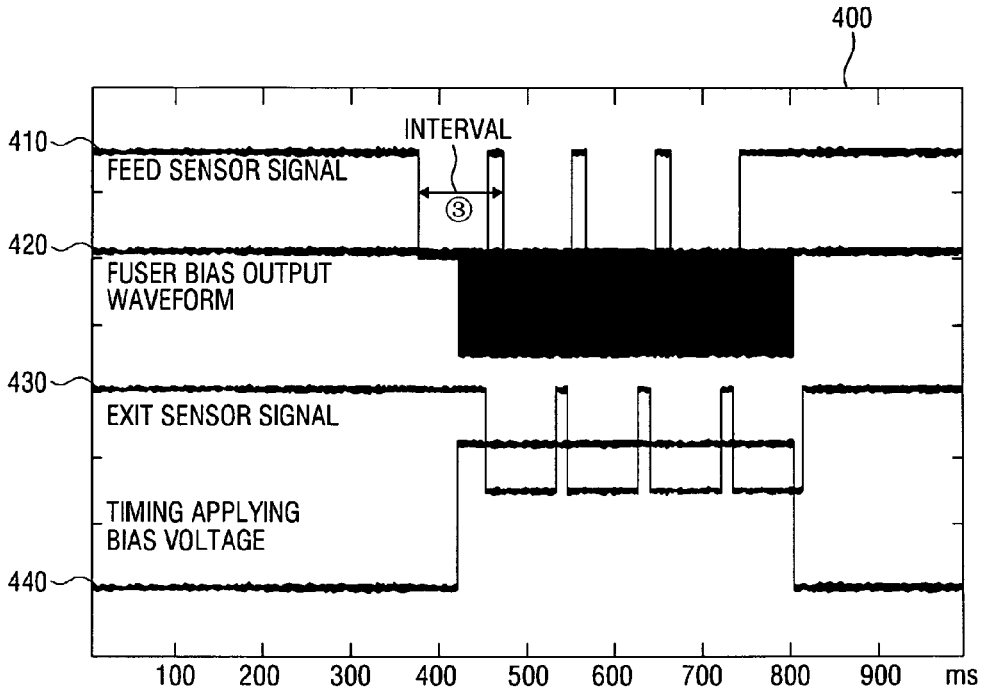

FIG. 4 is a waveform diagram of the change of the bias voltage when the interval of the printing papers entering the fuser 110 is shorter than the preset time. Specifically, FIG. 4 illustrates the waveform of a paper detection signal 410, a bias power 420, a paper detection signal 430 at the rear end of the fuser 110, and a timing 440 applying the bias voltage generated at the controller 140.

Hereafter, the operations of the components of the image forming apparatus 100 are explained according to the process of the printing paper by referring to FIG. 4.

First, when the paper detector 130 senses that the paper enters, it outputs the paper detection signal 410 as shown in FIG. 4.

When the paper detection signal 410 is output, the controller 140 can calculate that the printing paper enters the fuser 110 after 540 ms, using the distance (for example 57 mm) and the timing interval (150 ms) between the paper detector 130 and the fusing nip 113 and the printing paper delivery speed (for example 380 mm/s).

Using the calculated time, the controller 140 can generate the timing 440 applying the bias voltage to the pressure roller 112. For example, the controller 140 can generate the timing 440 applying the bias voltage such that the bias power is turned on after 540 ms after the ON-signal of the paper detector 130 is input.

Next, when the bias voltage is applied to the first printing paper, the controller 140 can determine whether to apply the bias power when the printing paper is not placed in the nip 113. In detail, the controller 140 can acquire the distance (57 mm) and the time interval (150 ms) between the printing papers using the time ③ (93 ms) between the first ON-signal and the second ON-signal of the paper detector 130 and the printing paper delivery speed (380 mm/s).

When the time for which the printing paper is not placed in the nip 113 is shorter than the preset time (for example 170 ms) as shown in FIG. 4, the controller 140 can control to apply the bias power when the printing paper is not placed in the nip 113.

In detail, the controller 140 can provide the power supply unit 120 with the control signal 440 which keeps turning on the bias power when the printing paper is not placed in the nip 113 as shown in FIG. 4. According to the control signal 440, the power supply unit 120 can apply the bias power 420 corresponding to the control signal 440 to the pressure roller 112.

As such, as the bias power is turned on continuously when the printing paper is not placed in the nip 113, the bias power on the pressure roller 112 can be transferred to the surface of the heat roller 111. However, only a small amount of the "+" voltage is transferred to the heat roller 111 and the transferred "+" voltage is small enough to be removed through the ground unit 116.

Figure 5:
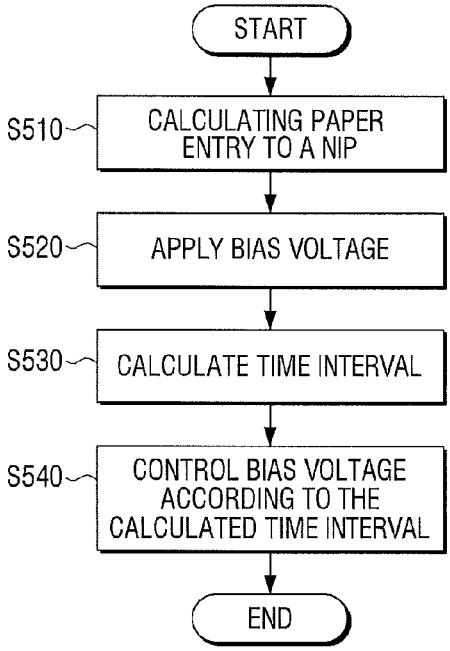
FIG. 5 is a flowchart of a method for controlling the fuser of the image forming apparatus according to an exemplary embodiment of the invention.

FIG. 5 is a flowchart of a method for controlling the fuser of the image forming apparatus according to an exemplary embodiment.

First, the method calculates the entrance of the printing paper to the nip 113 between the pressure roller and the heat roller after the printing paper enters. In detail, the feed sensor disposed on the general image forming apparatus 100 can be used to calculate the entrance of the printing paper to the nip 113 after detection of the printing paper by the feed sensor.

When the entrance of the printing paper to the nip 113 is calculated (S510), the method applies the bias voltage to the pressure roller 112 (S520). According to the printing paper signal detected by the sensor, the method calculates when the printing paper enters the nip 113 of the fuser. The method can generate the timing applying the bias voltage to the pressure roller 112 using the calculated time. The method can generate the bias voltage according to the generated timing applying the bias voltage and apply the generated bias voltage to the pressure roller.

Next, the method calculates the time interval between the printing paper fed to the nip 113 and the next printing paper (S530). In detail, the method can calculate the distance and the time interval between the printing papers using the printing paper detection signal detected at the printing paper sensor.

According to the time interval between the printing paper and the next printing paper, the method selectively controls to apply the bias voltage when the printing paper is not placed in the nip 113 (S540). More specifically, when the time for which the printing paper is not placed in the nip 113 is longer than the preset time (for example, 170 ms), the method can control not to apply the bias power when the printing paper is not placed in the nip 113. By contrast, when the time for which the printing paper is not placed in the nip 113 is shorter than the preset time (for example, 170 ms), the method can control to apply the bias power when the printing paper is not placed in the nip 113. This control method has been described in FIGS. 3 and 4 and shall not be further explained.

Meanwhile, while the fuser controlling method differs according to the time interval between the printing papers fed to the fuser 110 in FIG. 5, the fuser controlling method may differ according to the duplex printing or the simplex printing of the image forming apparatus 100 in the implementations.

Hence, by selectively controlling to or not to apply the bias voltage when the printing paper is not placed in the nip in the different manner according to the time interval of the printing papers entering the fuser, the fuser controlling method can minimize the offset even in the high-speed image forming apparatus. The fuser controlling method of FIG. 5 can be executed in the image forming apparatus of FIG. 1, or in an image forming apparatus of other structures.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a heat roller heated to a preset temperature;

a pressure roller to have conductivity and to form a nip by pressure-contacting with the heat roller;

a power supply unit to apply a bias voltage to the pressure roller; and a controller to, when a printing paper enters the nip, control the power supply unit to apply the bias voltage to the pressure roller, wherein, when a time interval between the printing paper and a next printing paper entering the nip is longer than a preset time, the controller controls the power supply unit not to apply the bias voltage when the printing paper is not placed in the nip, and when the time interval is shorter than the preset time, the controller controls the power supply unit to apply the bias voltage when the printing paper is not placed in the nip.

2. The image forming apparatus of claim 1, wherein the preset time is about 170 ms.

3. The image forming apparatus of claim 1, wherein, in a duplex printing, the controller determines that the time interval is longer than the preset time, and in a simplex printing, the controller determines that the time interval is shorter than the preset time, and selectively controls to or not to apply the bias voltage.

4. The image forming apparatus of claim 1, further comprising:

a paper detector to detect whether the printing paper enters a fuser, wherein, according to a detection result of the paper detector, the controller measures the time interval between the printing paper and a next printing paper.

5. The image forming apparatus of claim 1, wherein the power supply unit comprises:

a conductive member to contact a surface of the pressure roller; and a switching unit to provide the bias voltage to the conductive member according to control of the controller.

6. The image forming apparatus of claim 1, further comprising:

a ground unit disposed in vicinity of the nip into which the printing paper is fed, to remove charge on the surface of the heat roller.

7. The image forming apparatus of claim 1, wherein a charged toner is attached to an upper side of the printing paper contacting the heat roller, and the power supply unit supplies the bias voltage of a different polarity from the charged toner.

8. The image forming apparatus of claim 7, wherein the charged toner has a negative polarity, and the bias power has a positive polarity.

9. A method for controlling a fuser of an image forming apparatus, comprising:

calculating entrance of a printing paper to a nip between a pressure roller and a heat roller;

applying a bias voltage to the pressure roller using the detected result;

calculating a time interval between the printing paper entering the nip and a next printing paper; and selectively controlling to apply the bias voltage while the printing paper is not placed in the nip when the time interval is longer than a preset time, and to apply the bias voltage while the printing paper is not placed in the nip when the time interval is shorter than the preset time.

10. The method of claim 9, wherein the preset time is about 170 ms.

11. The method of claim 9, wherein the selectively controlling operation selectively controls to or not to apply the bias voltage by determining that the time interval is longer than the preset time in a duplex printing, and by determining that the time interval is shorter than the preset time in a simplex printing.

12. The method of claim 9, wherein a charged toner is attached to an upper side of the printing paper contacting the heat roller, and a power supply unit supplies the bias voltage of a different polarity from the charged toner.

13. The method of claim 12, wherein the charged toner has a negative polarity, and the bias power has a positive polarity.

* * * * *